US009234141B2

(12) United States Patent
O'Rear et al.

(10) Patent No.: US 9,234,141 B2
(45) **Date of Patent: *Jan. 12, 2016**

(54) PROCESS, METHOD, AND SYSTEM FOR REMOVING HEAVY METALS FROM OILY SOLIDS

(71) Applicants: Dennis John O'Rear, Petaluma, CA (US); Russell Evan Cooper, Martinez, CA (US); Kevin John Grice, Houston, TX (US)

(72) Inventors: Dennis John O'Rear, Petaluma, CA (US); Russell Evan Cooper, Martinez, CA (US); Kevin John Grice, Houston, TX (US)

(73) Assignee: Chevron U.S.A. Inc., San Ramon, CA (US)

( * ) Notice: Subject to any disclaimer, the term of this patent is extended or adjusted under 35 U.S.C. 154(b) by 288 days.

This patent is subject to a terminal disclaimer.

(21) Appl. No.: 13/804,430

(22) Filed: Mar. 14, 2013

(65) Prior Publication Data

US 2014/0262954 A1 Sep. 18, 2014

(51) Int. Cl.
*C10G 21/08* (2006.01)

(52) U.S. Cl.
CPC ..... *C10G 21/08* (2013.01)

(58) Field of Classification Search
CPC .... C10G 21/003; C10G 25/003; C10G 25/02; C10G 29/06; C10G 31/08; C10G 21/08; C10G 49/007; B01D 2257/602; B01D 53/64; B01D 2253/1128; B01D 12/00; C22B 43/00; C22B 3/0097; C22B 3/16; B09C 1/02; Y10S 210/912; Y10S 210/913; Y10S 210/914
USPC ..... 585/240–242, 833, 836–837, 840, 585/856–858; 208/177, 251 R
See application file for complete search history.

(56) References Cited

U.S. PATENT DOCUMENTS

| | | | | |
|---|---|---|---|---|
| 3,836,442 | A * | 9/1974 | Dean et. al. | 205/512 |
| 3,873,581 | A | 3/1975 | Fitzpatrick et al. | |
| 4,028,236 | A | 6/1977 | Townsend et al. | |
| 4,094,098 | A | 6/1978 | Gourley | |
| 4,094,777 | A | 6/1978 | Sugier et al. | |
| 4,108,769 | A | 8/1978 | Krieg et al. | |
| 4,133,755 | A | 1/1979 | Tarao et al. | |
| 4,151,077 | A | 4/1979 | Nogueira et al. | |
| 4,167,481 | A | 9/1979 | Cremers et al. | |
| 4,230,486 | A | 10/1980 | Capuano et al. | |
| 4,336,237 | A | 6/1982 | Kudryk et al. | |

(Continued)

OTHER PUBLICATIONS

Brevoort, G. H. "Abrasive Blasting and Salt Contamination: A Case History", May 1988, pp. 1-5.*

(Continued)

*Primary Examiner* — In Suk Bullock
*Assistant Examiner* — Aaron Pierpont

(57) ABSTRACT

Oil is recovered from a mercury containing Hg-containing solids containing abradants by mixing the solids with a sulfidic compound in a molar ratio of sulfur compound to mercury from 5:1 to 5,000:1, and the sulfidic compound when dissolved in water, yields S2-, SH—, Sx2-, or SxH— anions, and optionally a solvent, forming a mixture. The mixture is then separated to recover a first phase containing treated oil in water, and a second phase containing treated abradants having a reduced concentration of mercury. In one embodiment, the treated abradants contain less than 100 ppmw mercury. The abradants are provided by removing at least a portion of a mercury-containing coating from a surface by abradant blasting, laser ablation, laser thermal desorption, and sponge jet blasting.

16 Claims, 3 Drawing Sheets

(56) References Cited

U.S. PATENT DOCUMENTS

| | | | | |
|---|---|---|---|---|
| 4,338,288 | A | 7/1982 | Rollmann | |
| 4,354,942 | A | 10/1982 | Kaczur et al. | |
| 4,551,237 | A | 11/1985 | Fenton | |
| 4,578,195 | A | 3/1986 | Moore et al. | |
| 4,619,744 | A | 10/1986 | Horton | |
| 4,678,584 | A | 7/1987 | Elfline | |
| 4,708,853 | A | 11/1987 | Matviya et al. | |
| 4,709,118 | A | 11/1987 | Yan | |
| 4,752,397 | A | 6/1988 | Sood | |
| 4,876,025 | A | 10/1989 | Roydhouse | |
| 4,877,515 | A | 10/1989 | Audeh | |
| 4,880,527 | A | 11/1989 | Audeh | |
| 4,902,662 | A | 2/1990 | Toulhoat et al. | |
| 4,915,818 | A | 4/1990 | Yan | |
| 4,981,577 | A | 1/1991 | Audeh et al. | |
| 4,985,389 | A | 1/1991 | Audeh | |
| 5,034,203 | A | 7/1991 | Audeh et al. | |
| 5,037,552 | A | 8/1991 | Furuta et al. | |
| 5,107,060 | A | 4/1992 | Yan | |
| 5,110,480 | A | 5/1992 | Yan | |
| 5,173,286 | A | 12/1992 | Audeh | |
| 5,202,301 | A | 4/1993 | McNamara | |
| 5,238,488 | A | 8/1993 | Wilhelm | |
| 5,286,386 | A * | 2/1994 | Darian et al. | 210/639 |
| 5,304,693 | A | 4/1994 | Boitiaux et al. | |
| 5,336,835 | A | 8/1994 | McNamara | |
| 5,360,632 | A | 11/1994 | Johnson et al. | |
| 5,961,821 | A | 10/1999 | Varadaraj et al. | |
| 6,268,543 | B1 | 7/2001 | Sakai et al. | |
| 6,350,372 | B1 | 2/2002 | Degnan et al. | |
| 6,403,044 | B1 | 6/2002 | Litz et al. | |
| 6,475,451 | B1 | 11/2002 | Leppin et al. | |
| 6,521,131 | B1 | 2/2003 | Hamilton et al. | |
| 6,685,824 | B2 | 2/2004 | Frankiewicz et al. | |
| 6,866,048 | B2 | 3/2005 | Mattox | |
| 6,906,398 | B2 | 6/2005 | Yeo et al. | |
| 6,960,291 | B2 | 11/2005 | Greaney et al. | |
| 7,037,474 | B2 | 5/2006 | Nolan et al. | |
| 7,591,944 | B2 | 9/2009 | Carnell et al. | |
| 7,666,318 | B1 | 2/2010 | Lehtinen et al. | |
| 7,744,763 | B2 | 6/2010 | Cross et al. | |
| 2005/0263739 | A1 | 12/2005 | Mattox et al. | |
| 2006/0048646 | A1 | 3/2006 | Olson et al. | |
| 2008/0283470 | A1 | 11/2008 | Gustafsson et al. | |
| 2009/0114247 | A1 | 5/2009 | Brown et al. | |
| 2009/0304563 | A1 | 12/2009 | Harada et al. | |
| 2010/0000910 | A1 | 1/2010 | Gallup et al. | |
| 2010/0025184 | A1 | 2/2010 | Shibuya et al. | |
| 2010/0032344 | A1 | 2/2010 | Cross et al. | |
| 2010/0032345 | A1 | 2/2010 | Cross et al. | |
| 2010/0078358 | A1 | 4/2010 | Tullos et al. | |
| 2010/0099596 | A1 | 4/2010 | Trahan | |
| 2010/0126909 | A1 | 5/2010 | Bhasin et al. | |
| 2010/0155330 | A1 | 6/2010 | Burba et al. | |
| 2010/0200477 | A1 | 8/2010 | Varadi et al. | |
| 2010/0320124 | A1 | 12/2010 | Zhang et al. | |
| 2011/0163008 | A1 | 7/2011 | Zhang et al. | |
| 2012/0073601 | A1 * | 3/2012 | Lord et al. | 134/10 |

OTHER PUBLICATIONS

Pending U.S. Appl. No. 12/109,194, filed Apr. 24, 2008.
Pending U.S. Appl. No. 12/132,475, filed Jun. 3, 2008.
Pending U.S. Appl. No. 12/167,466, filed Jul. 3, 2008.
Pending U.S. Appl. No. 12/883,578, filed Sep. 16, 2010.
Pending U.S. Appl. No. 12/883,921, filed Sep. 16, 2010.
Pending U.S. Appl. No. 12/883,971, filed Sep. 16, 2010.
Pending U.S. Appl. No. 12/883,995, filed Sep. 16, 2010.
Pending U.S. Appl. No. 12/950,060, filed Nov. 19, 2010.
Pending U.S. Appl. No. 12/950,170, filed Nov. 19, 2010.
Pending U.S. Appl. No. 12/950,637, filed Nov. 19, 2010.
Pending U.S. Appl. No. 13/297,436, filed Nov. 16, 2011.
Pending U.S. Appl. No. 13/804,172, filed Mar. 14, 2013.
Pending U.S. Appl. No. 13/804,662, filed Mar. 14, 2013.
Pending U.S. Appl. No. 13/826,213, filed Mar. 14, 2013.
Pending U.S. Appl. No. 13/895,612, filed May 16, 2013.
Pending U.S. Appl. No. 13/895,754, filed May 16, 2013.
Pending U.S. Appl. No. 13/895,850, filed May 16, 2013.
Pending U.S. Appl. No. 13/895,983, filed May 16, 2013.
Pending U.S. Appl. No. 13/896,242, filed May 16, 2013.
Pending U.S. Appl. No. 13/896,255, filed May 16, 2013.

Ashworth, S. C., "Mercury Removal at Idaho National Engineering and Environmentally Laboratory's New Waste Calciner Facility," *Waste Management*, Feb. 27-Mar. 2, 2000, INEEL, Bechtel BWXT Idaho, LLC, Tucson, AZ, pp. 1-20.

Campanella et al., "Mercury Removal from Petrochemical Wastes," *Water Research*, 1986, vol. 20, No. 1, pp. 63-65.

Carrell et al., "Mercury Matters," *Hydrocarbon Engineering*, Dec. 2005, 3 pages.

Chaiyasit et al., "Decontamination of Mercury Contaminated Steel (API 5L-X52) Using Iodine and Iodide Lixiviant," *Modern Applied Science*, Jan. 2010, vol. 4, No. 1, pp. 12-20.

Clever et al., "The Solubility of Mercury and Some Sparingly Soluble Mercury Salts in Water and Aqueous Electrolyte Solutions," *Journal of Physical and Chemical Reference Data*, 1895, vol. 14, No. 3, pp. 631-680.

Corvini et al., "Mercury Removal from Natural Gas and Liquid Streams," *UOP LLC*, 2002, Houston, TX, pp. 1-9.

Findlay et al., "Removal of Elemental Mercury from Wastewaters Using Polysulfides," *Environmental Science and Technology*, Nov. 1981, vol. 15, No. 11, pp. 1388-1390.

Gildert et al., "Mercury Removal from Liquid Hydrocarbons in Ethylene Plants," *AIChE Paper* No. 135c, Mar. 24, 2010, Spring National Meeting, San Antonio, TX, 14 pages.

Kim et al., "Demulsification of Water-In-Crude Oil Emulsions by a Continuous Electrostatic Dehydrator," *Separation Science and Technology*, 2002, vol. 37, No. 6, pp. 1307-1320.

Larson et al., "Mass-Transfer Model of Mercury Removal from Water via Microemulsion Liquid Membranes," *Industrial & Engineering Chemistry Research*, 1994, vol. 33, No. 6, pp. 1612-1619.

Lemos et al., "Demusification of Water-in-Crude Oil Emulsions Using Ionic Liquids and Microwave Irradiation," *Energy Fuels*, 2010, vol. 24, pp. 4439-4444.

Morel et al., "The Chemical Cycle and Bioaccumulation of Mercury," *Annual Review Ecology, Evolution, and Systematics*, 1998, vol. 29, pp. 543-566.

Núñez et al., "Leaching of Cinnabar with HCl-Thiourea Solutions as the Basis of a Process for Mercury Obtention," *Metallurgical Transactions B*, Sep. 1996, vol. 17B, pp. 443-448.

Sharma et al., "Chemical Demulsification ofNatural Petroleum Emulsions of Assam (India)," *Colloid & Polymer Science*, 1982, vol. 260, pp. 616-622.

Sizeneva et al., "Applied Electrochemistry and Corrosion Protection of Metals: Mercury Passivation Solutions of Potassium Chloride and Sodium Hydroxide and Hypochlorite," *Russian Journal of Applied Chemistry*, 2009, vol. 82, No. 1, pp. 52-56.

Sizeneva et al., "Inorganic Synthesis and Industrial Inorganic Chemistry: A Study of Mercury Dissolution in Aqueous Solutions of Sodium Hypochlorite," *Russian Journal of Applied Chemistry*, 2005, vol. 78, No. 4, pp. 546-548.

Venkatesan et al., "Removal of Complexed Mercury by Dithiocarbamate Grafted on Mesoporous Silica," *Journal of Radioanalytical and Nuclear Chemistry*, 2003, vol. 256, No. 2, pp. 213-218.

Waldo, John H., "Some New Water-Soluble Organo-Mercury Compounds," *Water Soluble Organo Compounds*, Mar. 6, 1931, vol. 53, pp. 992-996.

Wasay et al., "Remediation of a Soil Polluted by Mercury with Acidic Hazardous Iodide," *Journal of Hazardous Materials*, 1995, vol. 44, pp. 93-102.

Yuan et al., "Fractions and Leaching Characteristics of Mercury in Coal," *Environmental Monitoring and Assessment*, Jan. 6, 2009, vol. 167, pp. 581-586.

Zhao et al., "Removal of Elemental Mercury by Sodium Chlorite Solution," *Chemical Engineering & Technology*, 2008, vol. 31, No. 3, pp. 350-354.

* cited by examiner

PROCESS, METHOD, AND SYSTEM FOR REMOVING HEAVY METALS FROM OILY SOLIDS

CROSS-REFERENCE TO RELATED APPLICATIONS

NONE

TECHNICAL FIELD

The invention relates generally to a process, method, and system for removing heavy metals such as mercury from solids.

BACKGROUND

Mercury containing ("Hg-containing") solids are commonly encountered in the oil & gas industry. They come from many sources, e.g., pigging wastes, tank bottom sediments, sediments from separators and other processing equipment, desalter fines, etc. Depending on the level of mercury and other hazardous wastes in the solids, there are various disposal options including non-hazardous land fill, encapsulation (e.g., in cement), incineration, hazardous land fill, and pyrolysis (or retorting).

There is a need for improved methods and systems for the treatment of Hg-containing solids, producing a treated solid portion with reduced mercury contents which can be subsequently disposed and optionally, an oil portion with reduced mercury contents.

SUMMARY

In one aspect, a method for removing a trace amount of mercury in Hg-containing solids is disclosed. The process comprises: mixing the solids containing an first amount of mercury with at least a treating agent selected from flocculants, sulfidic compounds, demulsifiers, and combinations thereof, forming a mixture, wherein the treating agent is added in an amount of 0.001 wt %-10 wt % based on weight of solids; and separating the mixture to obtain a first phase containing treated oil having an amount of mercury less than 50% of the first amount of mercury and a second phase containing treated solids having a reduced amount of mercury compared to the first amount.

In yet another aspect, a method for removing a trace amount of mercury in oily solids containing particulates from mercury removal filtration units. The process comprises the steps of: mixing the solids having a first amount of mercury with at least a sulfidic compound forming a mixture, wherein the sulfidic compound is present in a molar ratio of sulfur compound to mercury of at least 10:1, and the sulfidic compound when dissolved in water, yields $S^{2-}$, $SH^-$, $S_x^{2-}$, or $S_xH^-$ anions (where $S_x$ denotes a chain of sulfur atoms with lengths of two to eight); separating the mixture to recover a first phase containing treated oil having less than 50% of the first amount of mercury and a second phase containing treated solids having a reduced concentration of mercury. In one embodiment, the particulates comprise diatomaceous earth filter media are removed from a mercury removal filtration unit by backflushing the filter with treating solution. In another embodiment, the particulates comprise diatomaceous earth filter media are removed from a mercury removal filtration unit as dry powder, filter cake and/or slurry using mechanical means such as vibration, gentle tapping, to dislodge the filter cake.

In yet another aspect, the invention relates to a process to recover oil from Hg-containing solids. The process comprises: providing Hg-containing solids containing abradants, the Hg-containing solids having a first amount of mercury; mixing the Hg-containing solids containing abradants with a solvent and a sulfidic compound forming a mixture, wherein the sulfidic compound is present in a molar ratio of sulfur compound to mercury from 5:1 to 5,000:1, and the sulfidic compound when dissolved in water, yields $S^{2-}$, $SH^-$, $S_x^{2-}$, or $S_xH^-$ anions; and separating the mixture to recover a first phase containing solvent and a second phase containing treated abradants having a second amount of mercury which is less than the first amount of mercury.

DRAWINGS

DETAILED DESCRIPTION

Figure 1:
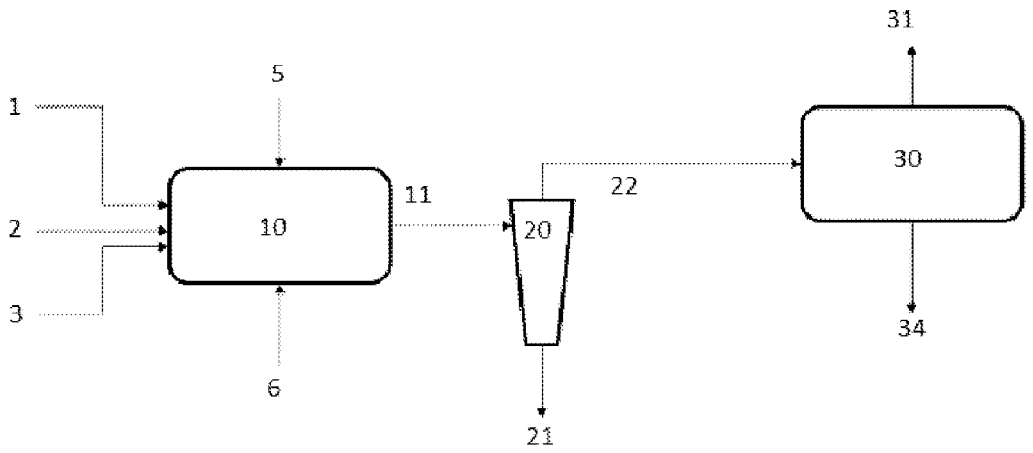
FIG. 1 is a block diagram of an embodiment of a system and a process to remove mercury from oily solids.

The following terms will be used throughout the specification and will have the following meanings unless otherwise indicated.

"Abradants" refers to a material used in abrading, scraping, or wearing down a surface, e.g., a substance that is used in abrasive blasting surfaces of equipment including but not limited to sand, grit, steel shot, furnace slag, fly ash, organic shell, etc. As used herein, "abradants" also include the material removed or scraped from a surface by abrasive blasting using an abradants.

"Trace amount" refers to the amount of mercury in the solids. The amount varies depending on the source of the solids. The trace amount is less than 10 wt % in one embodiment, less than 1 wt % in a second embodiment, from 10 ppm to 10 wt % in a third embodiment, and at least 50 ppm in a fourth embodiment.

"Hydrocarbon material" or hydrocarbons refers to a pure compound or mixtures of compounds containing hydrogen and carbon and optionally sulfur, nitrogen, oxygen, and other elements. Examples include crude petroleum, synthetic crude oils, petroleum products such as gasoline, jet fuel, diesel fuel, lubricant base oil, solvents, paraffin waxes, asphaltenes, and alcohols such as methanol and ethanol. The term "oil" or "oily" may be used interchangeably with "hydrocarbon material."

"Demulsifiers" or emulsion breakers, referring to specialty chemicals used to separate emulsions (e.g. water in oil).

"Coagulants" refers to compounds that neutralize the repulsive electrical charges (typically negative) surrounding particles in a liquid, allowing them to "stick together" creating clumps or flocs.

"Flocculants" (or flocculents) refers to compounds which facilitate the agglomeration or aggregation of the coagulated particles to form larger floccules and thereby hasten gravitational settling or floatation to the top of the liquid. Some coagulants serve a dual purpose of both coagulation and flocculation in that they create large flocs. Some coagulants also function as demulsifiers.

"Sulfidic compounds" refers to compounds that contain at least one sulfur atom reactive with mercury. Examples include but are not limited organic and inorganic compounds, e.g., dithiocarbamates, either in the monomeric or polymeric form, sulfurized olefins, mercaptans, thiophenes, thiophenols, mono and dithio organic acids, and mono and dithioesters, alkali metal sulfides, alkali metal polysulfides, alkaline earth metal sulfides, alkaline earth metal polysulfides, alkali metal trithiocarbonates, and mixtures thereof.

The determination of the oil, water and solid content of oily solid is done as follows for non-combustible solids: 15 mg. of solids are place in a pan and then onto a balance beam. The pan and the beam are moved into a furnace. In the first phase, 100 ml/min of $N_2$ flows over the sample and the temperature is increased at a rate of 10° C./minute. This continues until 550° C., when the gas is switched to air and the heating continues at 10° C./minute until 900° C. The amount of water in the sample is determined by the change of weight from 95 to 105° C. The amount of oil determined by the weight loss up to 900° C. minus the weight of water. The amount of solids is determined by the weight that remains at 900° C. The mercury content can be measured by Lumex™ or other suitable instrument.

For Hg-containing solids on combustible surfaces, e.g., personal protective equipment, the mercury content is measured on a sample that has been scraped from the surface.

The invention relates to the removal of mercury from solids, e.g., the separation and removal of mercury from the surfaces of the solid particles, especially where oil (hydrocarbon material) has to some extent has been adsorbed. The solids are brought into contact with at least a treating agent, optionally in the presence of a solvent such as water. The mixture is subsequently separated to recover solids with a reduced concentration of oil and mercury, and in one embodiment, oil with a reduced concentration of mercury.

Hg-Containing Solids:

Hg-containing solids (or mercury containing solids) referred to solids generated in the oil and gas industry, containing mercury, and with little or no hydrocarbon.

Oily Solids:

These are Hg-containing solids that also contain hydrocarbon materials. The hydrocarbon material may cover part of or all surfaces of the solids, or absorbed into part or all surfaces of the solids, or chemically integrated with the solids as compounds, or physically integrated into the solids (e.g., by permeating, attaching to, or residing on). In one embodiment, the oily solids comprise a mixture of any of wax, oil, sand, silt, grit, soil, sediments, precipitated asphaltenes, and water. The solids in oily solids have a hydrocarbon material content from 1 to 75 wt % in one embodiment; a solid content from 10 to 50 wt % in a second embodiment; a water content of up to 70 wt % in a third embodiment, with the concentrations being measured by simulated distillation amongst other techniques known in the art.

The appearance of Hg-containing solids and oily solids depends on the source, e.g., as thick mud, in a slurry form, solid residues, etc. The solids (particles) can be of sizes as small as fine particulates (less than 10 microns) or in larger sizes (e.g., pieces, chunks, flakes, etc.).

The type of mercury present in the solids varies according to the source. In one embodiment, the mercury detected in the solids is primarily mercury sulfide, e.g., greater than 50% meta-cinnabar as determined by Rietveld XRD refinement.

Sources of Hg-Containing Solids:

Hg-containing solids (with very little or any hydrocarbon material) may include metal or plastic surfaces with a coating of scale that contains mercury, or abradants used to remove mercury-containing scale from these surfaces.

Sources of Oily Solids

The sources and operations generating oily solids include but are not limited to drilling muds from drilling operations; soils containing oil and mercury from spill clean-up; oily sediments coating the inside of pipelines; sediment deposits on the bottom of crude oil tanks, processing vessels, or separators; surfaces and coating on the inside of equipment; oily sediments from upstream operations and waste processing facilities, wherein thousands of drums may be produced; solids from the processing of extra heavy oils or tars; and solids recovered from mercury removal operations in downstream operations.

In one drilling operation embodiment for the extraction of gas and/or oil, a drilling fluid or mud is used to provide lubrication and cooling to the drill bit and to remove cuttings from the bottom of the hole to the surface. The drill bit generates cuttings, e.g., small pieces of shale and rock, as it moves forward. Liquid contaminants such as water, brines, and crude oil from the formation can also get entrained in the drilling muds, generating oily solids. The oily solids generated typically comprise an oil-continuous phase, a discontinuous phase, and various aqueous solutions (such as sodium, potassium or calcium brines), along with other additives and solids (e.g., rheology modifiers like oleophilic clays, weighting agents like barium sulfate, fluid loss control agents and the like).

In SAGD operations (steam assisted gravity drainage), steam is injected for the recovery of heavy crude oil and bitumen, especially in projects involving oil wet sands (or oil wet tar sands), oil rocks, oil shales, containing the so-called non-conventional oils, i.e. extra heavy oils or tars. Condensed steam and oil are pumped to the surface wherein the oil is separated, leaving an oily/water mixture known as "produced water," containing 1-60 wt. % solids. The oily/water mixture is subject to a separation process, generating oily solids.

During refining operations at various stages in the process of refining crude petroleum oils to finished products, oily solids in the form of sludge are produced. The sludge may be found for example in heat exchanger bundle cleaning solids, leaded or unleaded tank bottoms, slop oil emulsion solids and API separator sludge.

Oily solids may also be on the surface of personal protection equipment (PPE) used in crude production, shipping and refining operations. Examples of PPE include but are not limited to coveralls, boots, boot coverings, gloves, tapes for sealing the PPE, glasses, goggles, face shields, helmets, respirators, respirator cartridges, gas sensors, clothes, ventilation tubing, drop cloths, etc. Personnel wearing PPE may be in contact with both oil and mercury, necessitating the disposal of the PPE, and consequently, the removal of mercury prior to the disposal of the PPE.

Oily solids can be generated from mercury removal filtration units. Some natural gas contains mercury at levels as high as 200 to 300 micrograms per cubic meter. Crude natural gas containing mercury can be treated in absorbers, e.g., a bed containing sulfur distributed over a carbon support. As the mercury removing system ages, the mercury level in the effluent gas will increase over time, and accumulating on the surface of equipment.

Mercury-containing and oily solids can be generated from the clean-up of oil spills, e.g., biodegradable materials such as ground up coconut husks, corn husks, etc. Oily solids can also be generated in the cleaning of equipment in the oil & gas industry, e.g., oil/gas platforms, oil pipes, tanks, containers, gas liquefaction apparatus which has been in contact with trace amounts of mercury, etc. The mercury is not necessarily present in a readily accessible form. In one embodiment, the Hg-containing solids comprise a portion of the solid surfaces, e.g., interior walls of tankers, distillation columns, vessels, railings, etc., along with traces of hydrocarbon material. The surfaces may be coated with a layer containing Hg with the layer in the form of scale, rust, polymeric resins, etc. In some embodiments, it is part of a hard scale that covers the equipment metal surface, e.g., a polymer coating (e.g., urethane, epoxy, etc.) employed to coat surfaces such as tanks or containers for storing crude.

Processes employed to clean surfaces generating Hg-containing solids including but not limited to laser ablation with the use of a laser beam to remove thin oil films; laser thermal desorption; sponge-jet blasting; abradant (abrasive blasting media) blasting, e.g., sand-blasting, hydro-blasting, $CO_2$-pellet blasting, air-abradant blasting, water-abradant blasting, surface blasting using grit, steel shot, furnace slag, fly ash, organic shell, urethane, and combinations thereof. In one embodiment with air abrasive blasting, the solids are in the form of a dry abrasive media such as sand. In another embodiment with water/abrasive-blasting, the solids are in a slurry form with a mixture of spent abrasive media in water.

In one embodiment prior to the removal/cleaning step generating Hg-containing solids, the surfaces are first de-oiled by any of steaming/steam-stripping, washing with detergent, washing with solvents (e.g., MeOH, EtOH, light aromatics, etc.), flushing with an inert gas, and heating. After deoiling, any of the above-mentioned processes can be used to remove the Hg from the de-oiled surface, forming abradants in the form of Hg-containing solids with very little if any residual oil.

Methods and systems to generate Hg-containing solids are disclosed in "Surface Cleaning by Laser Ablation" by Peebles et al. (presented at the Environmentally Conscious Manufacturing/Technology Applications Workshop, Albuquerque, 20 Feb. 1991); "Low temperature Low Temperature Surface Cleaning of Silicon and Its Application to Silicon MBE" by Ishizaka et al, J. Electrochem. Soc. 1986 volume 133, issue 4, 666-671; "Oil spills debris clean up by thermal desorption" by Araruna et al., Journal of Hazardous Materials, Vol. 110, Issues 1-3, 161-171; Novel Solution to Oil Spill Recovery: Using Thermodegradable Polyolefin Oil Superabsorbent Polymer (Oil—SAP) by Yuan et al., Energy Fuels, 2012, 26 (8), pp 4896-4902;

Oily solids can also be generated from processes employed to clean surfaces of equipment such as pipelines, wherein a cleaning "pig" is employed to scrape the inside of the pipelines, and optionally in combination with a heating element for cleaning the tools. The cleaning pigs scrape and dislodge deposits inside the pipelines, generating oily solids. Pigs refer to a disc, a spherical, or a cylindrical device made of a pliable material such as neoprene rubber and having an outside diameter nearly equal to the inside diameter of the pipeline to be cleaned. As the pig travels through the pipe, it scrapes the inside of the pipe and sweeps any accumulated contaminants or liquids ahead of it. In deepwater operations, pigging is also used to remove paraffin deposition in lines as part of production process.

Methods for the removal and cleaning of equipment with cleaning pigs are disclosed in Patent Publications U.S. Pat. No. 3,548,438A titled "Automatic oil well dewaxing system," U.S. Pat. No. 5,032,185A titled "Method and apparatus for removing paraffin from a fouled pipeline," U.S. Pat. No. 6,176,938B1 titled "Apparatus and method for removing material from pipelines," and U.S. Pat. No. 6,527,869B1 "Method for cleaning deposits from the interior of pipes," the relevant disclosure is included herein by reference.

Oily solids are also generated from processes to remove mercury from hydrocarbon liquids and gases, e.g., natural gas, crude oils, natural gas condensates and other liquid hydrocarbons (collectively, "mercury removal filtration units" or MRFUs). In MRFUs, particulates for the adsorbing or removal of mercury are brought into contact with the mercury-containing process streams, e.g., by mixing or agitation. Oily solids are generated when solids and particulates formed are separated from the mixture to produce treated hydrocarbons with reduced mercury levels. The solids can be any of activated carbon, polymeric materials such as polystyrene resins, clay, diatomaceous earth, adsorbents used in the art for removal of mercury from gas phase, and combinations thereof, supporting or impregnated with compounds for the removal of mercury.

Methods for the removal of mercury from liquid hydrocarbons in which oily solids are generated are disclosed in Patent Publications U.S. Pat. No. 6,685,824B2 titled "Process for removing mercury from liquid hydrocarbons using a sulfur-containing organic compound," U.S. Pat. No. 5,354,357A titled "Removal of mercury from process streams," and U.S. Pat. No. 6,537,443B1 titled "Process for removing mercury from liquid hydrocarbons."

Oily solids can also be generated using other methods known in the art, as disclosed in Patent Publications US20090173363A1 titled "System for cleaning an oil tank and method of cleaning an oil tank," U.S. Pat. No. 3,341,880A1 titled "Tank cleaning apparatus," US20090223871A1 titled "Methodology for the chemical and mechanical treatment and cleanup of oily soils, drill cuttings, refinery wastes, tank bottoms, and lagoons/pits," US20080314415A1 titled "Cleaning contaminated materials," US20080277165A1 titled "Method and system to recover usable oil-based drilling muds from used and unacceptable oil-based drilling muds," U.S. Pat. No. 8,287,441B2 titled "Apparatus and methods for remediating drill cuttings and other particulate materials," US20120145633A1 titled "Ultra-sound enhanced centrifugal separation of oil from oil from oily solids in water and wastewater," and US20120199517A1 titled "Process for the recovery of oils from a solid matrix," the relevant disclosure is included herein by reference.

Treating Agents:

Treating agents for the removal of mercury are selected from flocculants, sulfidic compounds, demulsifiers, and mixtures thereof.

In some embodiments, different treating agents are used, wherein the agents are added to the Hg-containing solids at the same time or in sequence, e.g., a treating agent that serves as a coagulant is first added to get the particles together forming flocs, followed by a second treating agent that serves as a flocculent to gather the coagulated particles forming large clumps or flocs for subsequent removal. In yet another embodiment, flocculants are first added to form clumps or flocs, followed by the removal of the flocs and subsequent additions of sulfidic compounds or complexing agents for the extraction/removal of mercury from the recovered oil and into the water phase.

The treating agents can be added all at once, incrementally, or in succession if different treating agents are used. The treating agents are added in an amount ranging from 0.001 wt % and 10 wt % based on the weight of solids. In a second embodiment, the amount is between 0.01 and 5 wt %. In a third embodiment, the amount is between 0.05 and 2 wt %. In a fourth embodiment, treating agents are added in an amount ranging from 0.1 to 1 wt. % based on weight of solids. In an embodiment with the use of a flocculant as a secondary treating agent, the secondary agent is employed in a low concentration, e.g., less than 50 parts per million weight (ppmw) based on the total weight of oily solids and solvent, to assist in the removal of suspended solids.

In one embodiment, the treating agents are selected from sulfidic compounds which dissolve in water to yield a solution with a pH greater than 7, and which contains sulfur species which, when dissolved, yield $S^{2-}$, $SH^-$, $S_x^{2-}$, or $S_xH^-$ anions, where x is an integer from two to eight. The sulfidic compounds in one embodiment are added in for a molar ratio of sulfur compound to mercury in the oily solids of at least 10:1 in one embodiment; and from 1000 to 10,000:1 in a second embodiment, for the conversion of mercury into water soluble mercury complexes. It is believed that in the starting mercury containing solid or oily solid most of the mercury is in the form of fine solids of meta-cinnabar. These are dissolved by the sulfidic compounds to form water soluble mercury complexes. Exemplary sulfidic compounds include but are not limited to potassium or sodium sulfide ($Na_2S$), sodium hydrosulfide (NaSH), potassium or sodium polysulfide ($Na_2S_x$), ammonium sulfide [$(NH_4)_2S$], ammonium hydrosulfide ($NH_4HS$), ammonium polysulfide [$(NH_4)_2S_x$], Group 1 and Group 2 counterparts of these materials, and combinations thereof. Sulfidic treating agents may contain a basic chemical, for example, in the form of NaOH, KOH, $NH_4OH$ or $Na_2CO_3$ to control the pH in the range of 7 to 12.

In one embodiment, the treating agents are flocculants selected from divalent and trivalent metal salts, e.g., ferric sulfate, ferrous sulfate, ferric chloride, ferric chloride sulfate, poly aluminum chloride, ferric nitrate, and ferric sulfide, aluminum sulfate, aluminum chloride, and sodium aluminate. In one embodiment, the flocculant is a trivalent ferric iron, e.g., ferric sulfate, in view of its availability, low cost, and ease of use. In another embodiment, the metal cation is provided as ferric chloride solution. In another embodiment, the metal cation is divalent ferrous iron, e.g., ferrous sulfate. In yet another embodiment, the metal cation is aluminum, e.g., hydrous aluminum oxide, provided at a pH of about 5.2.

In another embodiment, the treating agents are flocculants selected from water treating polymers. Water treating polymers referring to compounds that remove dissolved minerals from water by complexing with the minerals. Examples include but are not limited to nonionic, anionic, or cationic polymer or copolymer with different molecular weights and with various functional groups, such as acrylamide, acrylic acid, amine, acrylate, ethylene imine, ethylene oxide, etc. In another embodiment, the treating agent is an inorganic polymer such as aluminum chlorohydrate. In some implementations, the water treating polymer is an anionic high molecular weight polymer flocculant, with high molecular weight referring to a molecular weight above about 500,000 or above about 1,000,000.

In one embodiment, the water treating polymer is selected from the group of polyacrylic acid; polymaleic acid; copolymers and terpolymers of acrylic acid, maleic acid, acrylamide, and acrylamidopropyl sulfonate; prism polymers; sulfonate-based polymers; and terpolymers or copolymers of acrylic acid, acrylamide, sulfomethylated acrylamide, the like, and combinations thereof. In yet another embodiment, the treating agents are selected from cationic polymers such as polydiallyldimethylammonium chloride (polyDADMAC), cationic acrylamide copolymers, epichlorohydrin-dimethylamine polymers, and polyethyleneimine. In yet another embodiment, the water treating polymer is a polymer of epichlorhydrin-dimethylamine crosslinked with either ammonia or ethylenediamine; a linear polymer of epichlorhydrindimethylamine; a homopolymer of polyethyleneimine; polydiallyldimethyl ammonium chloride and a polymer of (meth)acrylamide and one or more cationic monomer selected from the group consisting of: dimethylaminoethyl (meth)acrylate methyl chloridequaternary salt, dimethylaminoethyl(meth)acrylate methyl sulfate quaternary salt, dimethylaminoethyl(meth)acrylate benzyl chloride quaternary slat, dimethylaminoethyl(meth)acrylate sulfuric acid salt, dimethylaminoethyl(meth)acrylate hydrochloric acid salt, dialkylaminoalkylacrylamides or methacrylamides and their quaternary or acid slats, acrylamidopropyltrimethyl ammonium chloride, diallyldiethyl ammonium chloride, diallyldimethyl ammonium chloride, dimethylamino propyl (meth)acrylamide methyl sulfate quaternary salt, and dimethylamino propyl(meth)acrylamide hydrochloric acid salt, diethylamino ethylacrylate, and diethylaminoethylmethacrylate. Other polymers are described in L. Lyons et al., "Water treating polymers," Chapter 7, pp. 113-145, 2007, included herein by reference.

In one embodiment, the treating agents are demulsifiers selected from the group of polyamines, polyamidoamines, polyimines, condensates of o-toluidine and formaldehyde, quaternary ammonium compounds, and ionic surfactants. In another embodiment, the demulsifier is selected from the group of polyoxyethylene alkyl phenols, their sulphonates and sodium sulphonates thereof. In yet another embodiment, the demulsifier is a polynuclear, aromatic sulfonic acid additive. In yet another embodiment, the demulsifier is selected from the list of polyalkoxylate block copolymers and ester derivatives; alkylphenol-aldehyde resin alkoxylates; polyalkoxylates of polyols or glycidyl ethers; polyamine polyalkoxylates and related cationic polymers; polyurethanes (carbamates) and polyalkoxylate derivatives; hyperbranched polymers; vinyl polymers; polysilicones; and mixtures thereof. In one embodiment, the demulsifier is a polyamine.

The pH of the mixture of solids/treating agent(s) is maintained at about 5-12 in one embodiment, from 6-9 in a second embodiment, and ~7 in a third embodiment.

Optional Solvent:

Depending on the source and form of the solids for mercury removal as well as the treating agent to be employed, a solvent such as water may or may not added to the mixture of solids and treating agents. For example, in an embodiment with the use of a sulfidic compound formed by dissolving hydrogen sulfide into an aqueous sodium hydroxide solution, the addition of a solvent such as water is optional.

In one embodiment, the solvent is a "clean" crude oil stream by itself. In another embodiment, the solvent is a light hydrocarbon material, e.g., xylene, benzene, toluene, kerosene, reformate (light aromatics), light naphtha, heavy naphtha, light cycle oil, medium cycle oil, propane, diesel boiling range material, and mixtures thereof, which is used to "wash" or dissolve oil from the solids. In another embodiment, the solvent is portable or non-portable water. Depending on the location of the process, the non-portable water can be any of connate water, aquifer water, seawater, desalinated water, oil fields produced water, industrial by-product water, and combinations thereof.

The solvent can be: a) added to the solids forming a slurry prior to the addition of the treating agent(s); b) added to the treating agent(s) prior to mixing with the solids; c) added concurrent with (or as part of) the treating agent(s); or d) added to the mixture of solids and treating agent(s).

In some embodiments, the solvent is added to "cause" the formation of the oily solids. In one embodiment with the use of cleaning pigs for the removal of contaminants, clogs, solids, etc. in a pipeline, solvents such as water or a dilute treating agent, e.g., aqueous sodium sulfide $Na_2S$, is used to flush the line when the operation is suspended to remove the solids for subsequent collection.

In one embodiment for the removal of mercury from abradants, water is added forming a slurry, with the subsequent recovery of "clean" abradants and mercury containing water. In another embodiment with oily solids such as tank bottom sediments or pigging waste, water is added along with optionally hydrocarbon materials for subsequent recovery of treated solids, treated crude, and mercury containing water.

In one embodiment for treating oily solids from a mercury removal filtration unit as disclosed in U.S. Pat. No. 6,537,443, a filtration apparatus with diatomaceous earth ("DE") filter media is used for the removal of mercury from crude oil or condensate. Water is added to clean the apparatus by back-flushing the filter, thus removing the mercury laden diatomaceous earth ("DE") filter media for collection as solids. In another embodiment and instead of using water, a dilute treating agent such as aqueous sodium sulfide $Na_2S$ is used as the solvent to back-flush the filtration apparatus to remove the DE filter media. In another embodiment the filter aid is dislodged and recovered from the mercury removal filtration unit (as semi-dried cake or slurry) by vibration, sonication, tapping, or other mechanical means.

The amount of solvent added depends on the original source/form of the solids to be treated (e.g., powder, slurry, sludge, etc.), the treating agents employed, and how the solvent is to be used (e.g., back-flushing a filter, flushing a pipeline, making a slurry, etc.). If the solvent contains some mercury, the initial amount of mercury measured in a mixture of the oily solid and the solvent is corrected for the amount of mercury in the solvent.

In one embodiment, water is added in an amount greater than 1 wt % based on the weight of solids in the Hg-containing solids in one embodiment; amount of 10 to 50 wt. % in a second embodiment; and greater than 10 times the weight of solids in a third embodiment; and from 50-1000 times the weight of solids in a fourth embodiment. In one embodiment, a sufficient amount of solvent, e.g., water, light hydrocarbon, is added for a weight ratio of liquid to solid from any of 5:1 to 100,000:1; from 10:1 to 50,000:1; from 15:1 to 10,000:1; from 50:1 to 2,000:1; and from 100:1 to 1000:1. The pH of the mixture after the addition of the solvent is maintained in the range of 5-12 in one embodiment, at least 7 in a second embodiment.

Process for the Removal of Mercury from Hg-Containing Solids:

The Hg-containing solids are mixed with the treating agent by means known in the art, optionally in the presence of a solvent such as water and/or hydrocarbon material, at a temperature ranging from ambient to 200° C. for a sufficient period of time for the removal of mercury. In one embodiment, the mixing generates a dense solid volume at a fairly fast settling rate. The solid volume with a reduced mercury concentration may be in the form of suspended matter as clumps or flocs of fine particulates, which can be recovered using liquid-solid separation means known in the art such as gravity separation, filtration, centrifugation, or the use of hydrocyclones.

In one embodiment, the contact between the oily solids and the treating agent can be at any temperature that is sufficiently high enough for the hydrocarbon material in the oily solids to be liquid. In another embodiment, the contact is at a temperature sufficient to reduce the amount of mercury partitioning to the hydrocarbon material and increase the proportion of mercury which partitions to the aqueous phase. In one embodiment, the contact is at room temperature. In another embodiment, the contact is at a sufficiently elevated temperature, e.g., at least 50° C. In one embodiment, the process is carried out about 20° C. to 65° C. Higher temperatures favor the extraction/removal of mercury from the oily solids. The mixing is carried out at a temperature of at least 40° C. in one embodiment, a temperature of 20° C. to 100° C. in a second embodiment, and from 40° C. to 60° C. in a third embodiment.

The contact time between the oily solids and the treating agent is sufficient for the mercury to be extracted/removed from the solids and into a water-oil emulsion, and subsequently into the water phase. In one embodiment, the contact time is sufficient for at least 50% of mercury to be removed from the solids. In a second embodiment, at least 75% removal. In a third embodiment, at least 90% removal. The contact time is at least 10 minutes in one embodiment; at least 30 minutes in a second embodiment; at least 2 hours in a third embodiment; from 30 minutes to 4 hours in a fourth embodiment.

In one embodiment, the mixing is carried out in a mixing tank or an in-line mixer. In another embodiment, the mixing is carried out in inclined plate settlers or lamella clarifiers, wherein the oily solids (optionally in water) enter the lamella clarifier, where it is flash mixed with the treating agent(s) and then gently agitated with a separate mixer. In one embodiment, as the mixture flows up the inclined plates, solids with reduced concentration of mercury settle out from the stream ("recovered" or "treated" solids), allowing the liquid phase with recovered oil and water to be collected.

In the next optional step, the water phase containing the mercury can be separated from the oil phase with a reduced concentration of mercury in a phase separation device known in the art, e.g., a cyclone device, electrostatic coalescent device, gravitational oil-water separator, centrifugal separator, etc., resulting in a recovered hydrocarbon material (e.g., crude) with a significantly reduced level of mercury, and recovered water phase containing mercury partitioned (extracted) from the original oily solids.

In one embodiment after the treatment of solids with at least a treating agent and prior to the removal of water, solvent in the form of crude oil (without solids/sediment) is added to the mixture of treated solids in an excess amount, e.g., a weight ratio of at least 100:1 solvent to treated solids, forming a blend. The blend is next sent to a desalter. The desalter can be a single stage desalter or a two-stage desalter. In the desalter, a small amount of wash water is optionally added (1-10 wt. % of the blend), for a waste water stream containing deoiled sediments in water and recovered oil with reduced mercury content. Other treating chemicals can also be optionally added to the desalter. In one embodiment, the desalter operating conditions include temperature of 200-400° F., ambient to 300 psia, 10 psi delta pressure, 15 to 60 minutes residence time, and 6,000 to 20,000 volts electrostatic field in the grid.

Depending on the type of treating agent employed, mercury can be extracted from the oily solids primarily to the recovered solids or recovered water phase. The amount of mercury in the recovered water phase is the difference between the original mercury concentration in the oily solids and the residual mercury in the recovered oil and the recovered (deoiled or treated) solids.

In one embodiment with the use of demulsifiers or flocculants as treating materials, less than 70% of the mercury in the original oily solids stays with recovered solids in one embodiment, at least 20% of the mercury being partitioned to the recovered water phase, for a recovered oil containing less than 10% of the original mercury. In a second embodiment, less than 80% of the original mercury remains with the recovered solids, at least 5% being partitioned to the water phase, for a recovered crude containing less than 15% of the original mercury. In a third embodiment, the recovered crude contains less than 5% of the original mercury, with at least 30% of the original mercury being partitioned to the recovered water phase, and the recovered solids with less than 65% of the original mercury.

In one embodiment with the use of sulfidic compounds as treating materials, the recovered crude contains less than 10% of the original mercury, with the remaining mercury being partitioned between the water phase and the recovered solids in a ratio of 1:3 to 3:1. In a second embodiment, the recovered crude contains less than 5% of the original mercury, with the remainder of the mercury stays primarily in the water phase (over 70% of the original mercury level), and a smaller amount in the recovered solids (less than 20%). In a third embodiment, the recovered (treated) crude contains less than 100 ppbw mercury.

The concentration of mercury in the recovered (treated) solids is below 4000 ppmw in one embodiment; 2000 ppmw in a second embodiment; below 20 ppmw in a third embodiment; and below 1 ppmw in a fourth embodiment. With respect to residual hydrocarbons, e.g., benzene and toluene, the concentration individually is below 1000 ppmw in one embodiment; below 100 ppmw in a second embodiment; and below 10 ppmw in a third embodiment.

The recovered solids with a reduced mercury content in one embodiment can be sent to a biological oxidation pond where they accumulate in the sludge. As most of the mercury in these sediments is in the form of HgS, the sludge is expected to pass leachability requirements. In another embodiment with recovered and deoiled diatomaceous earth ("DE" or other filter aid materials) having reduced concentration of mercury, the material can be reused in filtration units. The recovered DE can be used for pre-coating a filter by passing the recovered material in a solvent, e.g., water or sulfidic solution, through the filter in the forward direction until a sufficient thickness is deposited onto the filter. In yet another embodiment, recovered solids (abrasive-blasting media) can be reused in abrasive-blasting operations as grits.

Depending on the location of the system for the recovery/removal of mercury from the solids, any recovered water phase in one embodiment after separation from the solids/recovered hydrocarbon materials is injected back into the oil or gas reservoir (as dilution fluid to reservoir in production, or depleted reservoir). In another embodiment, recovered water is further treated before being injected into the reservoir or prior to being discharged. In yet another embodiment, recovered water is first treated to meet environmental regulations for water quality prior to discharge.

A system for the treatment of Hg-containing solids can be either land-based as part of a facility, e.g., a refinery or a water treatment unit, or it can be located off-shore (on a platform such as a floating production, storage and off-loading unit or FPSO, etc). The facilities may comprise one or more collection tanks for the storage of Hg-containing solids, and other equipment such as gravity separator, plate separator, hydroclone, coalescer, centrifuge, filter, collection tanks, etc. for the separation, storage, and treatment of recovered water after separation from the crude. In one embodiment, the system further comprises size reduction means known in the art, e.g., using crushers, grinders, ultrafine grinders, and cutting machines, to reduce the size of the Hg-containing solids are first reduced in size prior to contact with the treating agents.

Figures Illustrating Embodiments

Reference will be made to the Figures with diagrams schematically illustrating various systems and processes for removing mercury from Hg-containing solids.

In a system and a process to remove mercury from oily solids shown in FIG. 1, various process streams containing a variety of oily solids are sent to a mixing tank 10, including pigging waste 1, tank bottoms 2 and sediments collected from processing vessels 3. Produced water source 5 (and optional hydrocarbon material—not shown) is also added to the mixing tank 10. A demulsifier source (e.g., 0.1 wt. % polyamine demulsifier based on weight of solids) 6 is added to the tank 10. The mixture 11 is sent to a hydrocyclone 20 which separates a stream containing water and sediments 21 from a stream with reduced Hg-content oil and residual water 22. The reduced Hg-content oil with residual water is sent to an oil-water separator 30 for the separation and subsequent recovery of recovered water 34 and recovered oil 31 with a reduced Hg content oil. Although not shown, it is noted that either or both water streams 21 and 34 can be injected into an underground formation, e.g., a depleted oil, condensate, or gas reservoir, for disposal. The recovered oil stream 31 can be blended in with "new" crude, e.g., the crude that was co-produced with the produced water, for subsequent processing. The system as illustrated can be any of a mobile unit, located on-shore such as in a refinery, or off-shore on a facility such as an FPSO or other offshore facility for the production of oil and/or gas.

Figure 2:
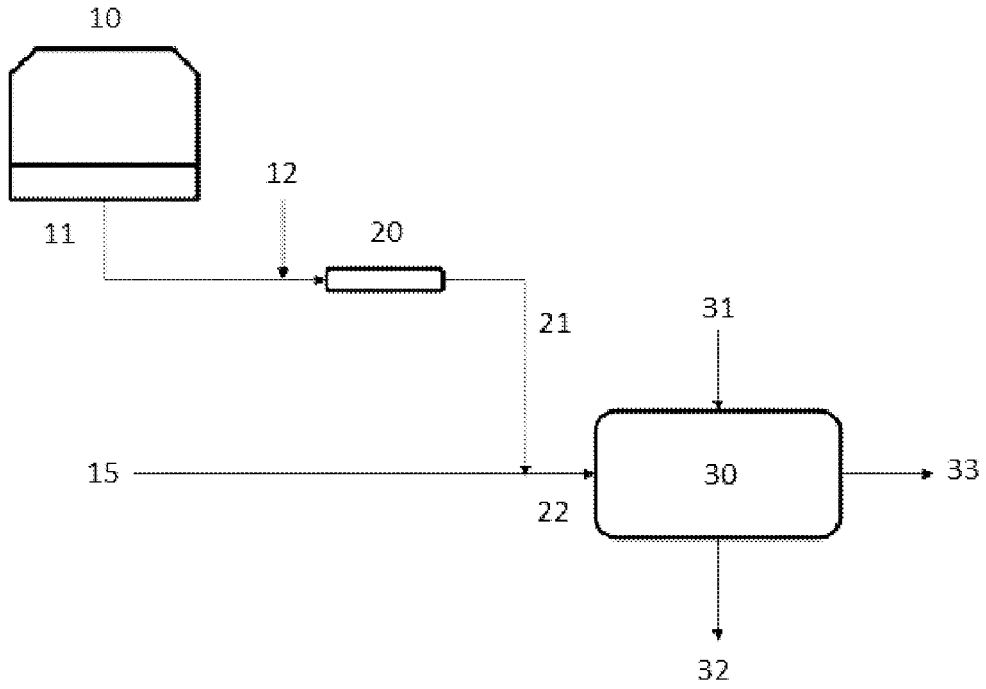
FIG. 2 is a block diagram of a second embodiment of a system and a process to treat oily solids.

In FIG. 2 of another embodiment of a process to treat oily solids, crude tank 10 is used to store sediment 11 which has accumulated over time. The sediment 11 contains oily solids. The sediment 11 is sent to a mixer 20, wherein the solids are mixed with at least a treating agent 12 (e.g., sulfidic compound or a demulsifier such as 0.1 wt. % cationic polyacrylamide), forming treated sediment 21. The treated stream 21 is mixed with an excess amount of a "solvent," a crude oil stream 15, forming a blend 22 which is sent to a desalter 30. A small amount of wash water 31, e.g., 3 wt % of the total weight of blend 22, is added to the desalter 30. Waste water stream 32 containing deoiled sediment is sent to waste disposal, and recovered crude oil with reduced Hg content 33 is recovered for further processing, e.g., distillation.

Figure 3A:
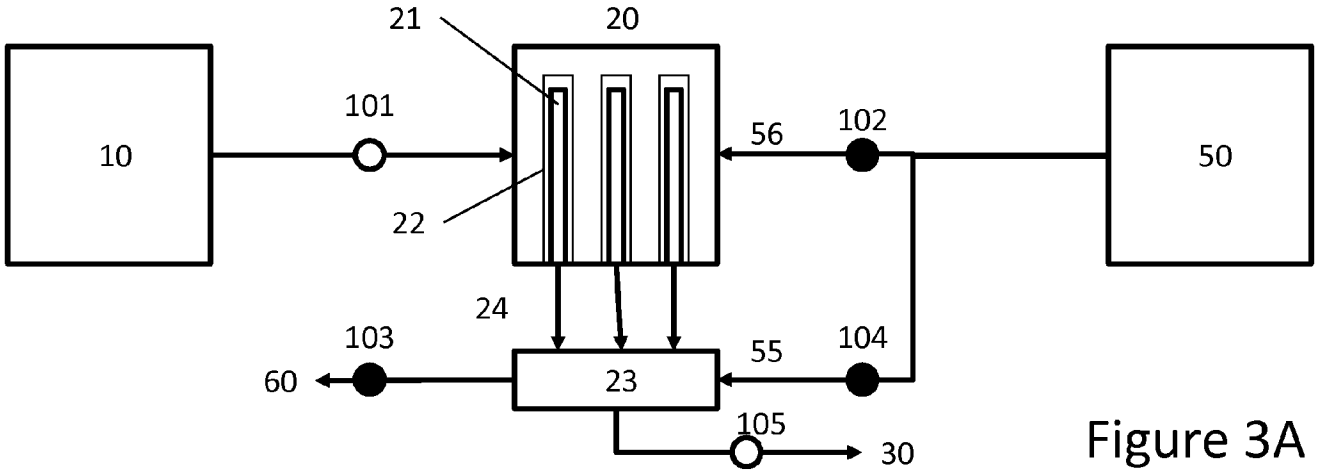
FIGS. 3A and 3B are block diagrams of a third embodiment of a system and a process to treat oily solids from a mercury removal filtration unit, showing different phases.
Figure 3B:
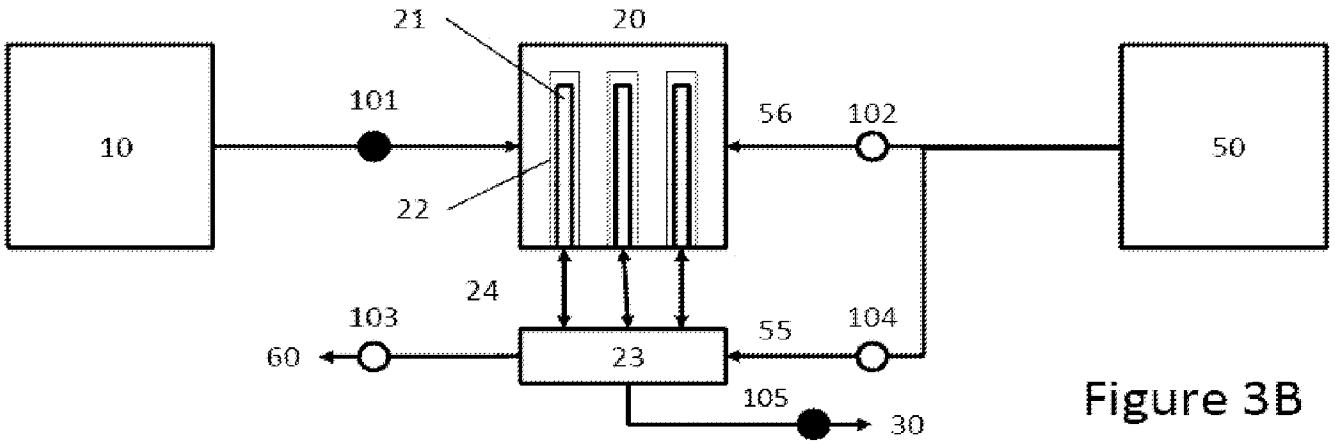

FIGS. 3A and 3B show yet another embodiment of a process and operation to treat oily solids from a mercury removal filtration unit. In FIG. 3A, a series of valves (101, 102, 103, 104, and 105) are in different positions depending on the phase of the operation, with "open" position being shown as empty circles and "closed" position being shown as filled circles. Valves 101 and 105 are open during filtration of the crude and the others are closed.

As shown, crude oil from storage tank 10 is pumped to filter assembly 20, comprising a number of filter elements 21 coated with a layer 22 of filter aid material, e.g., diatomaceous earth (DE), wherein particulate mercury is deposited on the DE and filtered oil collects in a manifold 23. Oil flows through the filter assembly 20 and particulate mercury and other contaminants are deposited onto the coated filter elements 21. Filtered oil 24 with a reduced concentration of mercury (e.g., less than 100 ppbw) is sent to storage 30.

During operation, when the pressure drop across the filter increases to a set limit, the filter cake is regenerated with the opening of valves 102, 103 and 104 at various times and the closing of others. Initially valves 102 and 103 are closed and only 104 is open. Crude is drained from the filter assembly 20, and an extracting agent 55, e.g., 10% sodium hydrosulfide solution in water is pumped from tank 50 to the manifold 23 and through the filter elements 21 to dislodge the filter aid material as well as most of the mercury incorporated therein. Extracting agent 56 is also sent to filter assembly 20 through valve 102. The spent sodium hydrosulfide solution containing dispersed DE is removed for disposal (not shown). The DE is expected to have 10 ppm Hg or less.

FIG. 3B illustrates the second phase of regeneration of the filter media, valve 104 is closed and valves 102 and 103 are open. Extracting agent 55 is pumped from tank 50 to the filter assembly 20, through the filter elements 21, into the manifold 23 through valve 103, and is collected as spent sodium hydrosulfide solution 60. During this second phase, the DE is redeposited on the filter elements 21 for use as filter aid material. At the end of this second phase, valve 102 is closed and the sodium hydrosulfide solution that remains in the filter assembly 20 is drained through the manifold 23 and collected as spent sodium hydrosulfide solution 60 for subsequent disposal or further treatment.

With regenerated filter aid material in place on the filter elements 21, the filtration process can re-start. Periodically the amount of solids removed from the crude will increase to the point that they must be removed from the filter assembly. This can be disposed along with the spent sodium hydrosulfide solution. The diatomaceous earth in this spent solution will contain 10 ppm mercury or less.

Figure 4:
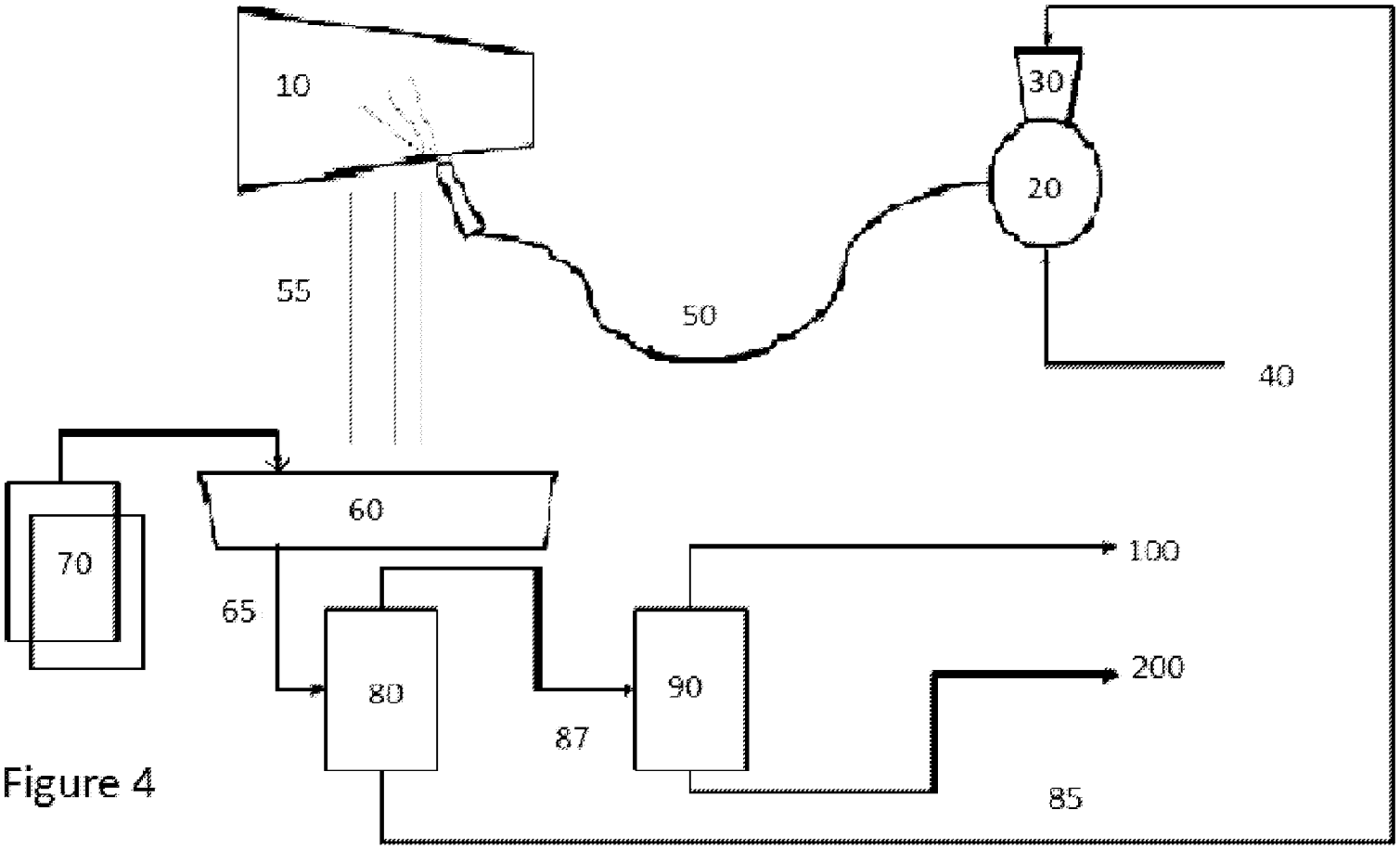
FIG. 4 is a block diagram of a third embodiment of a system and a process to treat Hg-containing solids from abrasive-blasting operations.

In FIG. 4 for a system to treat Hg-containing solids from an abrasive blasting operation, a metal wall 10 (e.g., of a crude cargo tanker, a container, etc.) is coated with epoxy and with some mercury. The wall is abrasive blasted by use of a sand blaster 20 equipped with a hopper 30, an air supply 40, and a hose equipped with a nozzle 50. Hg-containing solids in as spent blast media, e.g., sand and removed epoxy fragments 55 are collected in a spent media collector 60. Into this collector is pumped a 10% solution of sodium hydrosulfide in water 70. A mixture from the collector 65 flows to a first separator 80 where extracted sand 85 is removed and returned to the hopper. This extracted sand contains less than 10 ppm mercury.

An overhead stream from the first separator 87 is sent to a second separator 90, wherein sodium hydrosulfide solution 100 containing dissolved mercury is recovered. The solution 100 can be disposed by injection into an underground reservoir (not shown). In one embodiment (not shown), a portion of the sodium hydrosulfide solution 100 containing dissolved mercury can be recycled to vessel 70 and reused in the extraction. In one embodiment, the epoxy fragments are withdrawn as a bottom stream from vessel 90 and the sodium hydrosulfide solution containing dissolved mercury is withdrawn as an overhead stream from the separator 90.

The separators 80 and 90 can be separation equipment known in the art, e.g., API separator or hydrocyclones. They can also be combined into one separator that withdraws extracted (treated) sand from the bottom, sodium hydrosulfide solution containing dissolved mercury from a middle layer, and extracted (treated) epoxy fragments as an overhead layer.

Treated solids 200 containing epoxy fragments with less than 10 ppm mercury as recovered from the second separator can be washed and/or dried by equipment (not shown) for appropriate disposal.

EXAMPLES

The illustrative examples are intended to be non-limiting.

Example 1

A mercury-containing oily sediment was obtained from a commercial oil production operation as a black sticky dense solid. This material was characterized as-is and after room temperature toluene washing and drying. The toluene washing removed the oil leaving a grey-tan free-flowing solid resembling beach sand. However, the washing appeared not to remove significant mercury. Properties of the two samples are summarized in Table 1.

A simulated distillation was performed with a heating rate of 10° C./minute in two stages: room temperature to 550° C. under $N_2$ (100 ml/min), 550-900° C. under air (100 ml/min). The simulated distillation did not show a sharp peak near 212° F. indicative of water. Thus the weight percent solids in this oily solid is taken to be 87.65 wt. %, with the remained of 12.35 wt % being oil. The amount of water in the sample was negligible as shown by the absence of material boiling at 100° C.

The Rietveld XRD refinement detected meta-cinnabar as the sole crystalline mercury phase. A SEM analysis of the toluene-washed sample showed the presence of bright submicron sulfur-rich mercury solids (presumably meta-cinnabar) adhering to the surface of larger grains of quartz and clay particles, with occasional larger particles of sulfur-rich mercury solids.

TABLE 1

| Characteristic of Sample | As received | Toluene Washed |
|---|---|---|
| Mercury, ppbw | 74,900 | 133,000 |
| Crystal phase by Reitveld, % | | |
| Quartz | — | 84.3 |
| Albite | — | 14.7 |
| Calcite | — | 0.3 |
| Meta-cinnabar | — | 0.3 |
| Kaolinite | — | 0.1 |
| Illite | — | 0.1 |
| Weight Loss, simulated distillation % | | |
| @ 250° F. | 1.2 | — |
| @ 1000° F. | 12.35 | — |
| Horiba Particle Size Analysis | | |
| Median size, μ | — | 375 |
| Mean size, μ | — | 415 |
| Diameter on Cumulative % | | |
| 5% | — | 55 μ |
| 10% | — | 148 μ |
| 20% | — | 231 μ |
| 30% | — | 281 μ |
| 40% | — | 328 μ |
| 60% | — | 428 μ |
| 70% | — | 492 μ |
| 80% | — | 580 μ |
| 90% | — | 732 μ |
| 95% | — | 882 μ |

Example 2

Control

Approximately 0.25 grams of the as-received sample from Example 1 was placed in a 12 ml centrifuge tube. One ml of Supurla™ white oil was added and mixed. Five ml of water was added. The centrifuge tube was sealed, shaken, and mixed on a Vortex™ blender. It was then placed in a 60° C. oil bath for four hours. Afterwards, it was shaken again, and mixed for at least four hours on a rotating disc. Then it was placed in a heated centrifuge at 160° F. and rotated at 1500 RPM for 10 minutes. The centrifuge separated the mixture into an oil layer, a water layer, and a small amount of solids.

The oil and water layers were analyzed by Lumex™ analyzer to determine their mercury contents. The partitioning of mercury into the oil and water phases was calculated. 12% of the mass of the solid was assumed to be present in the oil layer as this represented the oil content of the original sample. The portion of mercury remaining in the solid as calculated by difference.

The results are shown in Table 2, with 30% of the mercury in the sample partitioned to the oil phase and 3% partitioned to the water phase. Without wishing to be bound by theory, it is believed that this mercury is present in the oil phase as highly dispersed fine solids of meta-cinnabar that were released from the surface of the quartz and clay.

TABLE 2

| Example | Key Agent | Oil Hg, ppbw | Water Hg, pbbw | % to oil | % to water | % to solid |
|---|---|---|---|---|---|---|
| 2 | NONE | 7,300 | 128 | 30 | 3 | 67 |

Examples 3 to 11

Various commercial demulsifiers were tested using the procedure of Example 2, but with the addition of 0.1 or 0.05 ml of demulsifier as shown. Tolad 9338 (alkylphenol-aldehyde resin alkoxylates) and DM083409 (polyamine) additives are from Baker Petrolite Corporation; PX0191 additive, EC2460A, EC2217 and FX2134 (polynuclear, aromatic sulfonic acid) additives are from Nalco Company; MXI-1928 (polyamine) and MXI-2476 (polynuclear, aromatic sulfonic acid) additives are from Multi-chem Group, LLC; and RIMI-84A Champion additive from Federal-Mogul Corporation. The demulsifier was added after the as-received sample was put in the centrifuge tube. The Supurla™ oil was added, as above, and mixed. The remaining steps of the procedure were the same. All demulsifiers reduced the amount of mercury which partitioned to the oil as shown in Table 3.

TABLE 3

| Example | Chemical | Amount ml | Oil Hg ppbw | Water Hg pbbw | % to oil | % to water | % to solid |
|---|---|---|---|---|---|---|---|
| 3 | Tolad 9338 additive | 0.1 | 1,153 | 561 | 5 | 13 | 82 |
| 4 | PX0191 additive | 0.05 | 250 | 370 | 1 | 6 | 93 |
| 5 | MXI-1928 additive | 0.05 | 225 | 142 | 1 | 5 | 94 |
| 6 | DM083409 additive | 0.05 | 358 | 107 | 1 | 3 | 97 |
| 7 | EC2217 A additive | 0.05 | 137 | 306 | 1 | 9 | 90 |
| 8 | MXI-2476 additive | 0.05 | 2,872 | 93 | 12 | 2 | 85 |
| 9 | EC2460A additive | 0.05 | 117 | 36 | 1 | 1 | 98 |
| 10 | RIMI-84A Champion additive | 0.05 | 927 | 6 | 4 | 0 | 96 |
| 11 | FX2134 additive | 0.05 | 102 | 213 | 4 | 6 | 90 |

Examples 12-17

Various water treating polymers supplied by Tramfloc, Inc. of Tempe, Ariz., were tested using the procedure of Examples 3-11. These anionic and cationic polyacrylamide emulsions reduced the mercury content of the oil to low values as seen with demulsifiers. In addition, the water retained mercury thus reducing the mercury content of the residual solids that were produced with the demulsifiers. Results are shown in Table 4.

TABLE 4

| Example | Chemical | Amount ml | Oil Hg, ppbw | Water Hg, pbbw | % to oil | % to water | % to solid |
|---|---|---|---|---|---|---|---|
| 12 | TRAMFLOC 141 polymer | 0.05 | 531 | 167 | 2 | 21 | 76 |
| 13 | TRAMFLOC 300 polymer | 0.05 | 167 | 770 | 1 | 21 | 78 |
| 14 | TRAMFLOC 304 polymer | 0.05 | 128 | 725 | 1 | 22 | 77 |
| 15 | TRAMFLOC 308 polymer | 0.05 | 166 | 863 | 1 | 21 | 79 |
| 16 | TRAMFLOC 330 polymer | 0.05 | 203 | 830 | 1 | 19 | 80 |
| 17 | TRAMFLOC 550 polymer | 0.05 | 2,602 | 173 | 10 | 4 | 86 |

Examples 18-26

Various water treating polymers supplied by Tramfloc, Inc. of Tempe, Ariz., were tested using the procedure of Examples 3-11. TRAMFLOC 552 and 723 polymers are polydialkyldiallylammonium salts. Other TRAFLOC materials are alkyl amine-epichlorohydrin compounds. The results are shown in Table 5.

TABLE 5

| Example | Chemical | Amount ml | Oil Hg, ppbw | Water Hg, pbbw | % to oil | % to water | % to solid |
|---|---|---|---|---|---|---|---|
| 18 | TRAMFLOC 552 polymer | 0.05 | 2,501 | 69 | 11 | 2 | 88 |
| 19 | TRAMFLOC 723 polymer | 0.05 | 1,285 | 171 | 6 | 4 | 90 |
| 20 | TRAMFLOC 861A polymer | 0.05 | 4,453 | 335 | 20 | 7 | 72 |
| 21 | TRAMFLOC 862A polymer | 0.05 | 2,698 | 57 | 13 | 1 | 86 |
| 22 | TRAMFLOC 864A polymer | 0.05 | 2,753 | 152 | 15 | 4 | 80 |
| 23 | TRAMFLOC 865A polymer | 0.05 | 1,641 | 331 | 8 | 8 | 84 |
| 24 | TRAMFLOC 866A polymer | 0.05 | 3,743 | 91 | 18 | 2 | 80 |

TABLE 5-continued

| Example | Chemical | Amount ml | Oil Hg, ppbw | Water Hg, pbbw | % to oil | % to water | % to solid |
|---|---|---|---|---|---|---|---|
| 25 | TRAMFLOC 867A polymer | 0.05 | 2,042 | 196 | 9 | 4 | 87 |
| 26 | TRAMFLOC 876 polymer | 0.05 | 2,349 | 187 | 12 | 5 | 83 |

Example 27

To evaluate the role of the chloride anion as a treating agent, 35% hydrochloric acid was used following the procedure of Examples 3-11 and the results are shown in Table 6. This agent resulted in approximately a doubling of the proportion of mercury that partitioned to the oil. Without wishing to be bound by theory, it is believed that acids, like hydrochloric, facilitate the transfer of HgS particles to the oil phase presumably as a micelle.

TABLE 6

| Example | Chemical | Amount ml | Oil Hg, ppbw | Water Hg, pbbw | % to oil | % to water | % to solid |
|---|---|---|---|---|---|---|---|
| 27 | HCl | 0.1 ml | 17,722 | 324 | 58 | 6 | 36 |

Examples 28-31

Various sulfidic agents were tested according the procedure of Examples 3-11 and the results are shown in Table 7. These materials gave significantly lower partitioning of the mercury to the oil phase. Tetragard™ sodium polysulfide (from Tessenderlo Kerley Inc. of Phoenix, Ariz.), NaSH, and sodium sulfide simultaneously gave a significant increase in the partitioning of the mercury to the aqueous phase. These materials can be used to simultaneously give oil with a reduced mercury content and a solid with reduced mercury content.

TABLE 7

| Example | Chemical | Amount ml | S/Hg Molar Ratio | Oil Hg, ppbw | Water Hg, pbbw | % to oil | % to water | % to solid |
|---|---|---|---|---|---|---|---|---|
| 28 | Tetragard ™ $Na_2S_x$ | 0.1 | 9096 | 1,704 | 3,116 | 7 | 77 | 16 |
| 29 | NaSH | 0.1 | 4909 | 2,672 | 1,873 | 14 | 55 | 32 |
| 30 | Ammonium Sulfide | 0.1 | 3680 | 793 | 1,022 | 4 | 28 | 69 |
| 31 | Sodium Sulfide | 0.1 | 5042 | 2,955 | 2,098 | 15 | 63 | 22 |

Example 32

Ferric chloride was tested according the procedure of Examples 3-11 and the results are shown in Table 8. Like the sulfidic agents, this flocculating agent simultaneously gave a lower partitioning of the mercury to the oil phase and an increased partitioning to the water phase.

TABLE 8

| Example | Chemical | Amount mg | Oil Hg, ppbw | Water Hg, pbbw | % to oil | % to water | % to solid |
|---|---|---|---|---|---|---|---|
| 32 | $FeCl_3$ | 0.1271 g | 790 | 2,036 | 3 | 50 | 47 |

Example 33

Oily solids in the form of diatomaceous earth or "DE" (Celatom FW-12 DE) filter media employed in Example 4 of U.S. Pat. No. 6,537,443 is removed from the filter by back-flushing the filter as a means of cleaning the filter. A sufficient amount of aqueous sodium sulfide $Na_2S$ at 1.6 wt. % concentration (0.67 wt. % sulfur) is added to the mercury-containing DE for a ratio of liquid to solid of about 20:1. The sample is tested according to the procedure of Example 2. It is expected that after treatment with the $Na_2S$ solution, at least 70% of the mercury is partitioned to the water, with less than 10% remaining on the oil, and less than 20% in the DE. At least a portion of the recovered (regenerated) DE after mercury removal can be reapplied onto the filter, and reused to remove mercury from crude or condensate.

Example 34

Example 33 is repeated, except that instead of using water to back-flush/clean the filter and remove the DE, a stream of aqueous sodium sulfide $Na_2S$ at 1.6 wt. % concentration is used instead. It is expected that after back-flushing with the $Na_2S$ solution, at least 50% of the mercury is partitioned to the water, with less than 20% remaining on the oil, and less than 30% in the DE. As in Example 34, the recovered DE can be reapplied onto the filter to remove mercury from crude or condensate.

Example 35

A commercial Floating Production Storage and Off loading (FPSO) vessel used to store mercury-containing crude was emptied of crude and ventilated. The walls of the FPSO had been coated with an epoxy resin to prevent corrosion. A hand-held XRF analytical gun was used to measure the amount of mercury on the surface expressed on an area-basis. Four samples were analyzed and then the epoxy coating was scraped from the metal. The metal surface was re-analyzed and found to contain significantly less mercury, showing that some mercury is embedded in the epoxy coating and can be removed by abrasive blasting, scraping and similar procedures. Once the mercury is removed, the vessel will be more suitable for reclamation as scrap.

Mercury was not detected in the vapor phase indicating that elemental mercury was not present in significant amounts.

The mercury in the epoxy is some form of non-volatile mercury, presumably meta-cinnabar. A summary of the results is shown below.

TABLE 9

| Experiment | 34 | 35 | 36 | 37 |
|---|---|---|---|---|
| Location | Coating Edge 1 | Coating Edge 2 | Tank Wall 1 | Tank Wall 2 |
| Initial, $\mu g/cm^2$ | 6535 | 5864 | 840 | 5603 |
| Scraped, $\mu g/cm^2$ | 290 | 332 | 126 | 2372 |
| % Reduction | 96 | 94 | 85 | 58 |

Example 36

Surfaces on epoxy-coated vessel walls were mechanically scraped/removed from various locations on a tank on a FPSO, e.g., tank ceiling, main tank wall, coating edge, tank bottom, etc., by abrasive blasting such as sand blasting. Area-based mercury concentrations before and after scraping showed an average reduction of at least 75%. The average mercury concentration of the removed solids was measured to be at least 20 ppm. The solids were found to comprise primarily epoxy, iron oxides, iron sulfides, along with other metal oxides and sulfides. The solids also include abradants used to remove the epoxy coating from the walls of the vessel. The solid scales were first reduced in size to powder with the use of a grinder.

Example 37

About 0.25 grams sample of oily solids from Example 36 is placed in a 12 ml centrifuge tube along with 0.1 ml sulfidic agent Tetragard™ sodium polysulfide solution and 6 ml of water. It is expected that at least 50% of the mercury is partitioned to the water, with less than 10% remaining on the oil, and less than 35% in the solids. The mercury content of the recovered solids is expected to be 10 ppm or less, and it passes applicable leachability tests. This qualifies it for disposal in a cement kiln or in a suitable land fill.

For the purposes of this specification and appended claims, unless otherwise indicated, all numbers expressing quantities, percentages or proportions, and other numerical values used in the specification and claims are to be understood as being modified in all instances by the term "about." Accordingly, unless indicated to the contrary, the numerical parameters set forth in the following specification and attached claims are approximations that can vary depending upon the desired properties sought to be obtained by the present invention. It is noted that, as used in this specification and the appended claims, the singular forms "a," "an," and "the," include plural references unless expressly and unequivocally limited to one referent.

As used herein, the term "include" and its grammatical variants are intended to be non-limiting, such that recitation of items in a list is not to the exclusion of other like items that can be substituted or added to the listed items. The terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Unless otherwise defined, all terms, including technical and scientific terms used in the description, have the same meaning as commonly understood by one of ordinary skill in the art to which this invention belongs.

This written description uses examples to disclose the invention, including the best mode, and also to enable any person skilled in the art to make and use the invention. The patentable scope is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims. All citations referred herein are expressly incorporated herein by reference.

The invention claimed is:

1. A process to recover oil from Hg-containing solids, the process comprising:

providing Hg-containing solids containing abradants, the Hg-containing solids having a first amount of mercury;

mixing the Hg-containing solids containing abradants with a solvent and a sulfidic compound forming a mixture, wherein the sulfidic compound is present in a molar ratio of sulfidic compound to mercury from 5:1 to 5,000:1, and the sulfidic compound dissolves in water and yields $S^{2-}$, $SH^-$, $S_x^{2-}$, or $S_xH^-$ anions, and wherein the sulfidic compound is selected from potassium polysulfide, sodium polysulfide ($Na_2S_x$), ammonium sulfide [$(NH_4)_2S$], ammonium hydrosulfide ($NH_4HS$), ammonium polysulfide [$(NH_4)_2S_x$], Group 1 and Group 2 counterparts of these materials, sulfide-containing polymers, and combinations thereof, and wherein the sulfidic compound converts and extract mercury to soluble mercury complexes in water;

separating the mixture to recover a first phase containing solvent and a second phase containing treated abradants having a second amount of mercury which is less than the first amount of mercury; and recovering the treated abradants for use as abrasive blasting media in abrasive-blasting equipment.

2. The process of claim 1, wherein the solvent is water and the first phase containing water has more than 50% of the first amount of mercury and the second phase containing treated abradants has less than 50% of the first amount of mercury.

3. The process of claim 2, wherein the first phase containing water has more than 75% of the first amount of mercury and the second phase containing the treated abradants has less than 25% of the first amount of mercury.

4. The process of claim 3, wherein the first phase containing water has more than 90% of the first amount of mercury and the second phase containing the treated abradants has less than 10% of the first amount of mercury.

5. The process of claim 1, wherein the treated abradants have less than 100 ppbw mercury.

6. The process of claim 1, wherein providing Hg-containing solids containing abradants comprises:

removing at least a portion of a mercury-containing surface by abradant blasting, laser ablation, laser thermal desorption, sponge jet blasting and combinations thereof.

7. The process of claim 6, wherein abradant blasting is by any of sand-blasting, hydro-blasting, $CO_2$-pellet blasting, air-blasting, water-blasting, and surface blasting using any of grit, steel shot, furnace slag, fly ash, organic shell, urethane, and combinations thereof.

8. The process of claim 6, whether the mercury-containing surface is deoiled prior to abradants blasting by any of steaming, steam-stripping, detergent washing, solvent washing, flushing with an inert gas, and heating.

9. The process of claim 1, wherein the second amount of mercury in the treated abradants is greater than 50% meta-cinnabar as determined by Rietveld XRD refinement.

10. The process of claim 1, wherein the abradants are selected from sand, alumina, metal particles, zirconia, titania, and mixtures thereof.

11. The process of claim 1, wherein the solvent is added for a weight ratio of solvent to Hg-containing solids of 15:1 to 10,000:1, wherein the solvent is added prior to separating the mixture.

12. The process of claim 11, wherein the solvent is water and wherein water is added for a weight ratio of water to Hg-containing solids of 50:1 to 2,000:1.

13. The process of claim 12, wherein the water is selected from connate water, aquifer water, seawater, desalinated water, oil fields produced water, industrial by-product water, and combinations thereof.

14. The process of claim 1, wherein the separation is carried out by any of gravity separation, centrifugation, hydrocyclones, and combinations thereof.

15. A process to recover oil from Hg-containing solids, the process comprising:

providing Hg-containing solids containing abradants obtained from removing a mercury-containing coating from a surface by abradant blasting, laser ablation, laser thermal desorption, sponge jet blasting and combinations thereof, the Hg-containing solids having a first amount of mercury;

mixing the Hg-containing solids containing abradants with a sulfidic compound in water forming a mixture, wherein the sulfidic compound is present in a molar ratio of sulfidic compound to mercury from 5:1 to 5,000:1, and the sulfidic compound dissolves in water and yields $S^{2-}$, $SH^-$, $S_x^{2-}$, or $S_xH^-$ anions and wherein the sulfidic compound is selected from potassium polysulfide, sodium polysulfide ($Na_2S_x$), ammonium sulfide [$(NH_4)_2S$], ammonium hydrosulfide ($NH_4HS$), ammonium polysulfide [$(NH_4)_2S_x$], Group 1 and Group 2 counterparts of these materials, and combinations thereof, and wherein the sulfidic compound converts and extracts mercury to soluble mercury complexes in water;

separating the mixture to recover a first phase containing water having less than 50% of the first amount of mercury and a second phase containing treated abradants having a second amount of mercury which is less than the first amount of mercury; and further comprising recovering the treated abradants for use as abrasive blasting media in abrasive-blasting equipment.

16. The process of claim 15, wherein the treated abradants contain less than 100 ppbw mercury.

* * * * *